US011753830B2

(12) United States Patent
Repasky et al.

(10) Patent No.: US 11,753,830 B2
(45) **Date of Patent: *Sep. 12, 2023**

(54) PAVER SUPPORTING APPARATUS

(71) Applicant: Hanover Prest-Paving Company, Hanover, PA (US)

(72) Inventors: Kevin Repasky, Hanover, PA (US); Brian Repasky, York, PA (US)

(73) Assignee: Hanover Prest-Paving Company, Hanover, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/075,216

(22) Filed: Oct. 20, 2020

(65) Prior Publication Data

US 2021/0032878 A1 Feb. 4, 2021

Related U.S. Application Data

(63) Continuation of application No. 16/357,416, filed on Mar. 19, 2019, now Pat. No. 10,844,613.

(51) Int. Cl.

| | |
|---|---|
| ***E04F 15/02*** | (2006.01) |
| ***E04F 15/024*** | (2006.01) |
| ***E04D 11/00*** | (2006.01) |

(52) U.S. Cl.

CPC ..... *E04F 15/02494* (2013.01); *E04D 11/007* (2013.01); *E04F 15/02452* (2013.01); *E04F 15/02458* (2013.01); *E04F 15/02464* (2013.01)

(58) Field of Classification Search

CPC ..... E04F 15/02494; E04F 15/02452; E04F 15/02464; E04F 15/02458; E04D 11/007

See application file for complete search history.

(56) References Cited

U.S. PATENT DOCUMENTS

| | | | |
|---|---|---|---|
| 3,318,057 | A | 5/1967 | Norsworthy |
| 3,466,824 | A | 9/1969 | Troutner |
| 3,616,584 | A | 11/1971 | Sartori et al. |
| 4,085,557 | A | 4/1978 | Tharp |
| 4,277,923 | A | 7/1981 | Rebentisch et al. |
| 4,417,426 | A | 11/1983 | Meng |
| 4,558,544 | A | 12/1985 | Albrecht et al. |
| 4,570,397 | A | 2/1986 | Creske |
| 4,736,555 | A | 4/1988 | Nagare et al. |
| 4,759,162 | A | 7/1988 | Wyse |
| 4,780,571 | A | 10/1988 | Huang |
| 4,901,490 | A | 2/1990 | Zinniel et al. |

(Continued)

FOREIGN PATENT DOCUMENTS

| | | |
|---|---|---|
| DE | 10103001 C1 | 10/2002 |
| EP | 3251492 A1 | 12/2017 |
| WO | 2016181328 A1 | 11/2016 |

OTHER PUBLICATIONS

PCT Written Opinion of the International Search Authority and the International Search Report, dated May 17, 2021, 7 pages.

(Continued)

*Primary Examiner* — Beth A Stephan
(74) *Attorney, Agent, or Firm* — Barley Snyder

(57) ABSTRACT

The invention relates to a paver supporting apparatus. The paver supporting apparatus has a pedestal with a top plate. A modular grid is positioned on the top plate and has a ballast receiving opening and a ballast is located in the ballast receiving opening.

24 Claims, 8 Drawing Sheets

(56) References Cited

U.S. PATENT DOCUMENTS

| | | | | |
|---|---|---|---|---|
| 4,996,804 | A | 3/1991 | Naka et al. | |
| 5,323,575 | A | 6/1994 | Yeh | |
| 5,333,423 | A | 8/1994 | Propst | |
| 5,377,468 | A | 1/1995 | Repasky | |
| 5,412,914 | A | 5/1995 | Daw et al. | |
| 5,442,882 | A | 8/1995 | Repasky | |
| 5,479,745 | A | 1/1996 | Kawai et al. | |
| 5,588,264 | A | 12/1996 | Buzon | |
| 5,791,096 | A | 8/1998 | Chen | |
| 5,862,635 | A | 1/1999 | Linse et al. | |
| 5,983,582 | A | 11/1999 | Vugrek | |
| 6,202,374 | B1 | 3/2001 | Cooper et al. | |
| 6,332,292 | B1 | 12/2001 | Buzon | |
| 6,363,685 | B1 | 4/2002 | Kugler | |
| 6,520,471 | B2 | 2/2003 | Jones et al. | |
| 6,604,330 | B2 | 8/2003 | Repasky | |
| 6,851,236 | B1 | 2/2005 | Harvey | |
| 7,650,726 | B2 | 1/2010 | Jakob-Bamberg et al. | |
| 8,128,312 | B2 | 3/2012 | Stuchell | |
| 8,490,234 | B2 | 7/2013 | Rowell et al. | |
| 8,528,274 | B2 | 9/2013 | Zlatar | |
| 8,555,545 | B2 | 10/2013 | Fischer et al. | |
| 8,898,999 | B1 * | 12/2014 | Kugler | E04F 15/02464 52/126.6 |
| 9,499,992 | B2 | 11/2016 | Busby | |
| 9,879,385 | B2 | 1/2018 | Tabibnia | |
| 10,538,923 | B2 * | 1/2020 | Marchetti | E04F 15/105 |
| 10,844,613 | B2 * | 11/2020 | Repasky | E04F 15/02494 |
| 2002/0078638 | A1 | 6/2002 | Huang | |
| 2002/0148173 | A1 | 10/2002 | Kugler | |
| 2004/0035064 | A1 | 2/2004 | Kugler et al. | |
| 2004/0074170 | A1 | 4/2004 | Huang | |
| 2004/0261325 | A1 | 12/2004 | Glynos | |
| 2008/0053017 | A1 | 3/2008 | Hockemeyer et al. | |
| 2008/0053018 | A1 | 3/2008 | Hockemeyer et al. | |
| 2008/0105172 | A1 | 5/2008 | Repasky | |
| 2008/0222973 | A1 | 9/2008 | Lee et al. | |
| 2010/0064609 | A1 | 3/2010 | Busby et al. | |
| 2011/0138723 | A1 | 6/2011 | Repasky | |
| 2011/0203200 | A1 | 8/2011 | Marquardt et al. | |
| 2013/0104464 | A1 | 5/2013 | Meyer | |

OTHER PUBLICATIONS

Bison, "Bison Deck Supports ScrewJack B-Series Specifications", pp. 1-4, Oct. 6, 2005.

Bison, "Bison ScrewJack B Series Pedestals", pp. 1-2, Sep. 30, 2005.

Elmich, "VersiJack", 9 pages, Oct. 9, 2006.

Wausau Tile, "Pedestal/Roof Deck System Components", (http://www.wausautile.com/paving/pedestalRoofDeckSystems.cfm) Apr. 3, 2009.

Wausau Tile, "Terra System One Level Installation, Terr-Adjust System", (http://www.wausautile.com), Apr. 3, 2009.

Wausau Tile, "Terra System One Level Installation, Terra-Stand System", (http://www.wausautile.com), Apr. 3, 2009.

Westile, "Pedestals", (http://www.westile.com/pedestal.asp?img=13&cat=comm&ped=acc) Apr. 3, 2009.

Westile, "ScrewJack Pedestals", (http://www.westile.com), Dec. 2006.

SilcaSystem, A Better Way to Build a Deck, www.SilcaSystem.com, 2 pages.

SilcaSystem, Intstallation Guide for Silca Grate, www.SilcaSystem.com, 2 pages.

Extended European Search Report, dated May 20, 2020, 10 pages.

* cited by examiner

PAVER SUPPORTING APPARATUS

CROSS-REFERENCE TO RELATED APPLICATIONS

This claims priority under 35 U.S.C. § 119 to U.S. patent application Ser. No. 16/357,416, filed Mar. 19, 2019.

FIELD OF THE INVENTION

The invention is related to a paver supporting apparatus, and more particularly a paver supporting apparatus with a modular grid.

BACKGROUND

Pavers, tiles, or other floor panels, referred to hereinafter simply as pavers, are used in a variety of architectural and landscape settings. Sometimes pavers are installed in gardens, patios, walkways, driveways, or on the roofs of buildings. Some types of pavers are made from heavy materials and have physically large dimensions, making them resistant to movement after installation. Such is the case, when pavers are used for landscaping, sidewalks, patios and driveways. In other applications, pavers have less weight, limiting the load on the surface over which they are installed. In some cases, access to an object that is underneath the installed paver is required. In this type of installation, the paver may be elevated from an installed surface and have access channels or pathways underneath. In installations, such as this, the paver may be lightweight and form an elevated walkway. In the case of an elevated installation, the pavers may become airborne and dislodged in a high wind condition. What is needed is a paver supporting apparatus that provides reduced surface load, ease of access to under paver objects, while preventing pavers from becoming dislodged from an elevated installed surface in a high wind condition.

SUMMARY

A paver supporting apparatus having a pedestal having a top plate, a modular grid positioned on the top plate, having a ballast receiving opening, and a ballast located in the ballast receiving opening.

BRIEF DESCRIPTION OF THE DRAWINGS

The invention will now be described by way of example with reference to the accompanying figures of which.

DETAILED DESCRIPTION OF THE EMBODIMENT(S)

Figure 1:
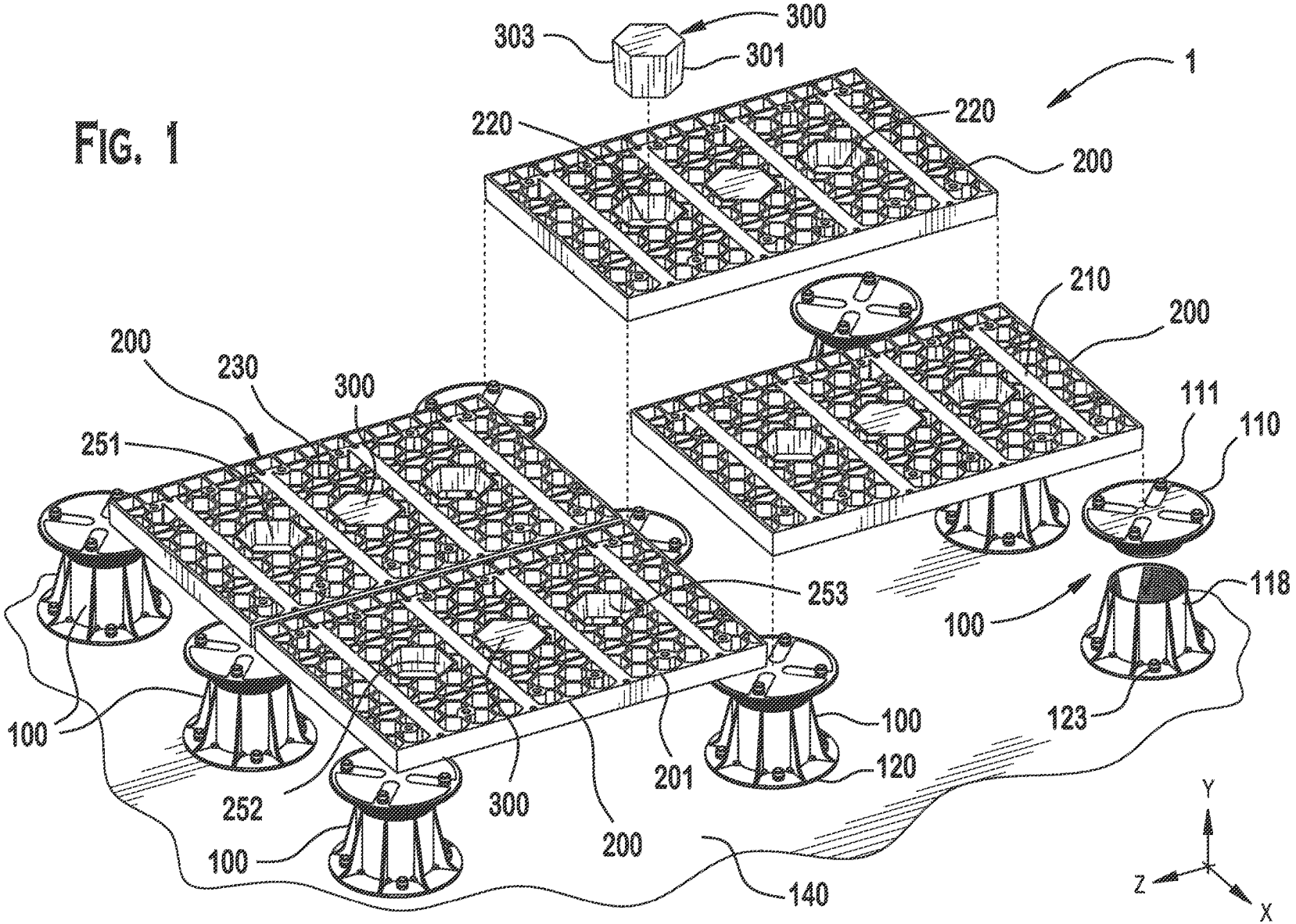
FIG. 1 is a partial exploded perspective view of a paver supporting apparatus according to the invention, shown being assembled.

Exemplary embodiments of the invention will be described hereinafter in detail with reference to the attached drawings, wherein like reference numerals refer to like elements.

The invention may, however, be embodied in many different forms and should not be construed as being limited to the embodiments set forth herein; rather, these embodiments are provided so that the present disclosure will convey the concept of the disclosure to those skilled in the art.

Now with reference to the figures, an exemplary paver supporting apparatus 1, according to the invention, will be described. Referring first to FIG. 1, the paver supporting apparatus 1, generally includes the following major components: a pedestal 100, a modular grid 200, and a ballast 300.

Figure 2:
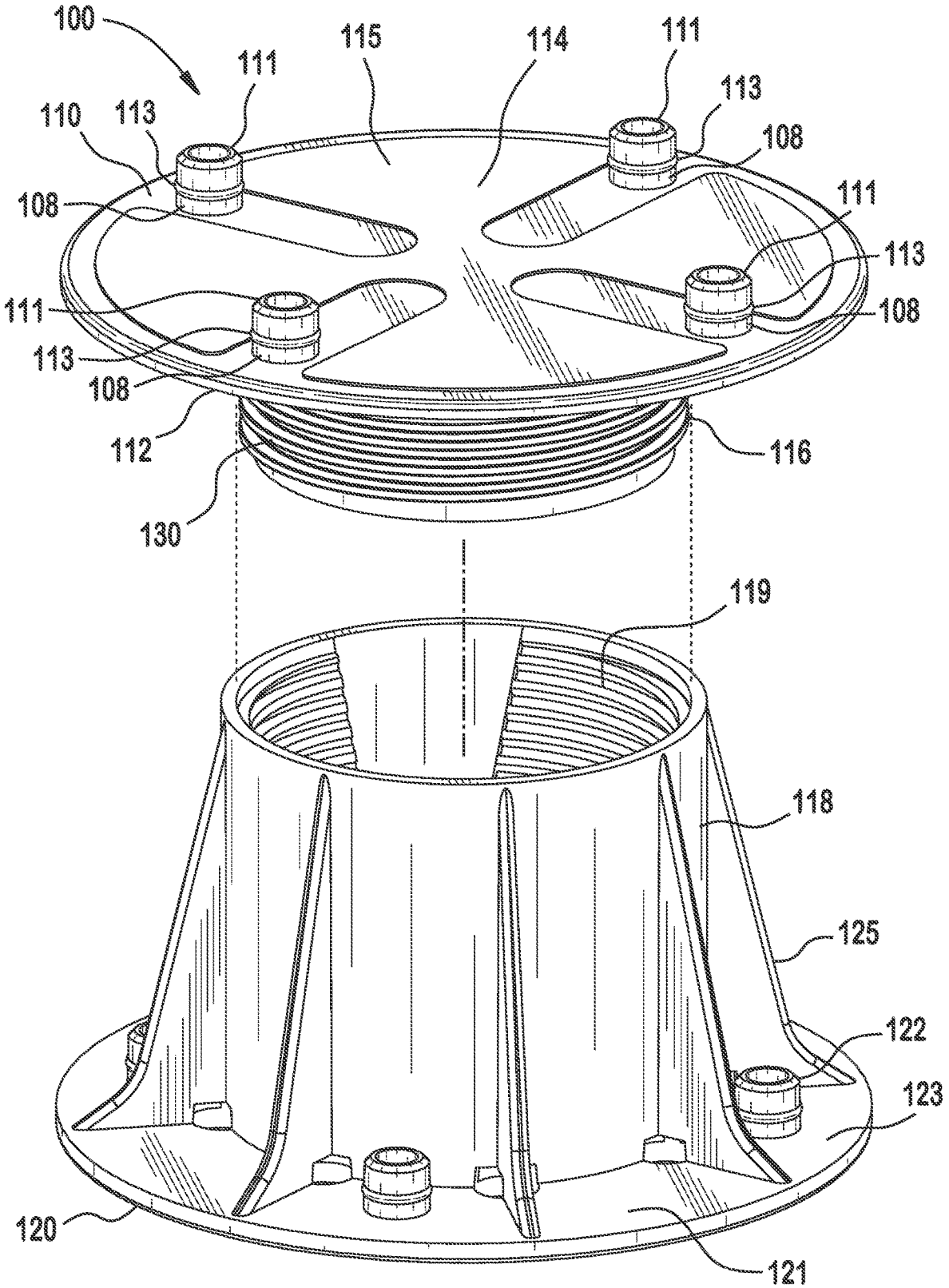
FIG. 2 is an exploded view of a pedestal of a paver supporting apparatus of FIG. 1.

Each of these major components will now be described in greater detail. Referring to FIGS. 1 and 2, the pedestal 100 generally includes a top plate 110, a plurality of male lock pins 111, a dampener 114, a plate extender 116, and a pedestal column 118.

In the shown embodiment, the top plate 110 is substantially round with a circumference 112. The plurality of male lock pins 111, are generally positioned along a pair of crossing diagonals such that the outline of the plurality of male lock pins 111 is approximately square, as illustrated in FIG. 1. Along the top plate 110 is a dampener 114. The dampener 114 may be formed of any suitable dampening material to provide a dampening effect to the modular grid 200. As shown in FIG. 2, the dampener 114 is an insert molded rubber pad 115 insert molded into the top plate 110 and extending substantially over the surface of the top plate 110 in a cloverleaf like pattern. The dampener 114 forms an elevated surface along portions of the top plate 110.

Figure 2A:
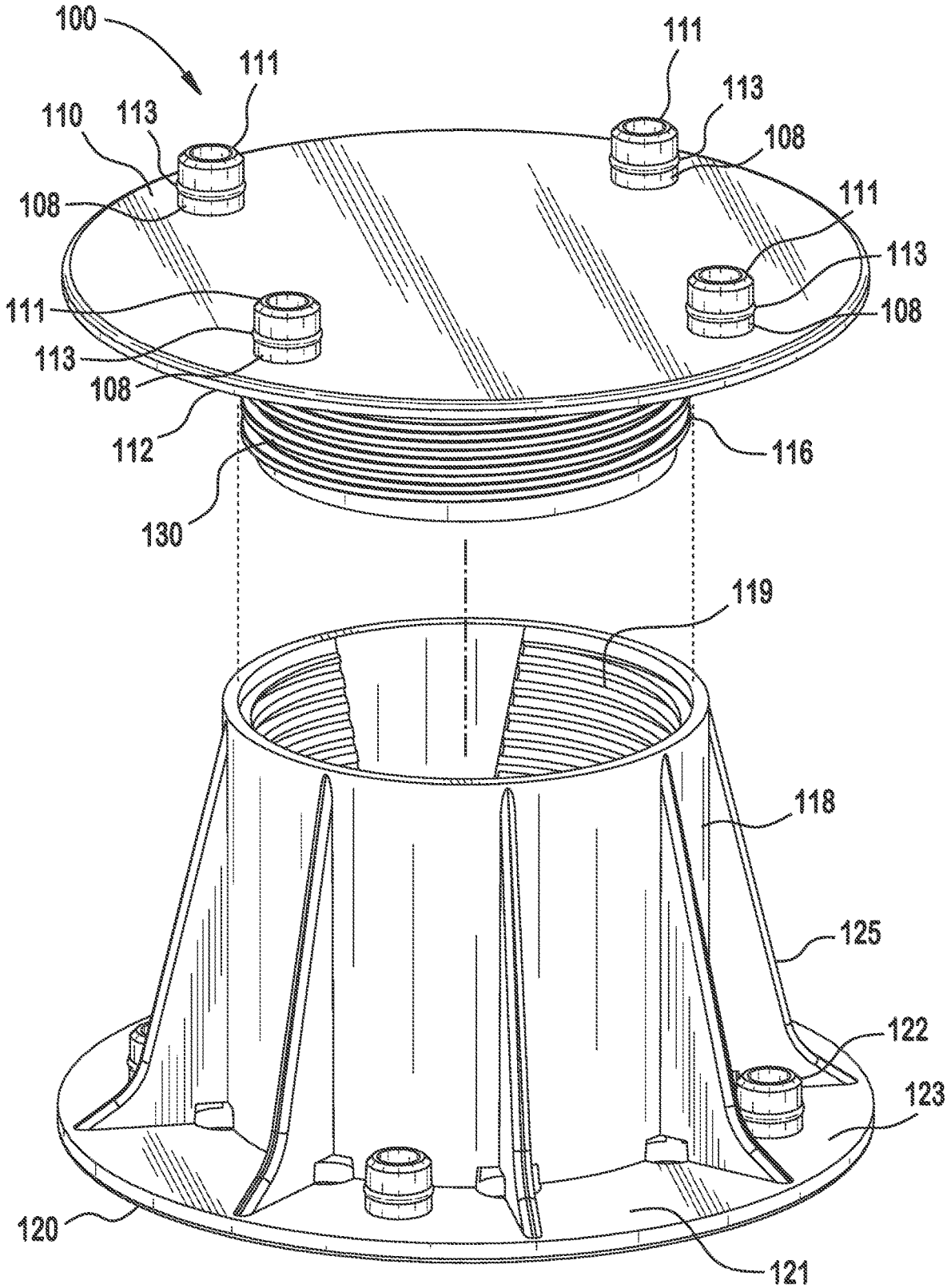
FIG. 2A is an exploded view of another pedestal of a paver supporting apparatus according to the invention.

With reference to FIG. 2A, another pedestal 100 of a paver supporting apparatus according to the invention is shown. As an alternative to the top plate 110 shown in FIG. 2, the top plate 110 of FIG. 2A has a planar surface and no dampener 114 thereon. Similar to the pedestal 100 of FIG. 2, the top plate 110 is substantially round with a circumference 112. The plurality of male lock pins 111, are generally positioned along a pair of crossing diagonals such that the outline of the plurality of male lock pins 111 is approximately square, as illustrated in FIGS. 1, 2, and 2A. Additionally, the male lock pins 111, along the bottommost portion of the lower medial portion 108, intersect with the planar surface of the top plate 110 and are coplanar with the top plate 110 over the entire planar surface of the top plate 110.

The plurality of male lock pins 111, are positioned around the circumference 112, of the top plate 110. Along a lower medial portion 108, on each one of the plurality of male lock pins 111, is a rib 113, as shown in FIG. 2, 2A. The rib 113, extends around the circumference of each one of the plurality of male lock pins 111. As illustrated, the rib 113 is semi-circular and adjacent the top plate 110. As shown in FIG. 2, each one of the ribs 113 is positioned between the portions of the dampener 114 forming the openings in the cloverleaf like pattern such that each one of the ribs 113 is separated from an adjacent rib 113 by a portion of the dampener 114.

As shown in FIG. 2, 2A, positioned beneath the top plate 110, along a central columnar section, is the plate extender 116. The plate extender 116, has a threaded surface 130 extending substantially around the plate extender 116 and along the length of the plate extender 116.

The pedestal column 118 is positioned along a vertical section of the pedestal 100. Extending around a circumference of the pedestal column 118 are a plurality of reinforcement arms 125. At an end of the pedestal column 118 is a circular base 120. The circular base 120 forms a flange 121 with a plurality of fastener openings 122 positioned along a face 123 of the circular base 120. The plurality of fastener openings 122 are positioned along the face 123 in an alternating pattern between the plurality of reinforcement arms 125.

Along an inner surface of the pedestal column 118 is an interior thread 119. The interior thread 119 extends substantially along the length and the inner circumference of the pedestal column 118. The interior thread 119 provides substantial displacement along the interior of the pedestal column 118 in a positive and negative column height direction.

As shown in FIGS. 1, 3, 4, 5, and 8 the modular grid 200 generally has a top surface 201, a plurality of a pedestal receiver 205, and a plurality of ballast receiving openings 250. The top surface 201 has a plurality of a planar adhesive receiving section 210 in portions and a geometric lattice 230 in others. Further, the modular grid 200 has a plurality of receiving spaces positioned in and along the modular grid 200.

Figure 3:
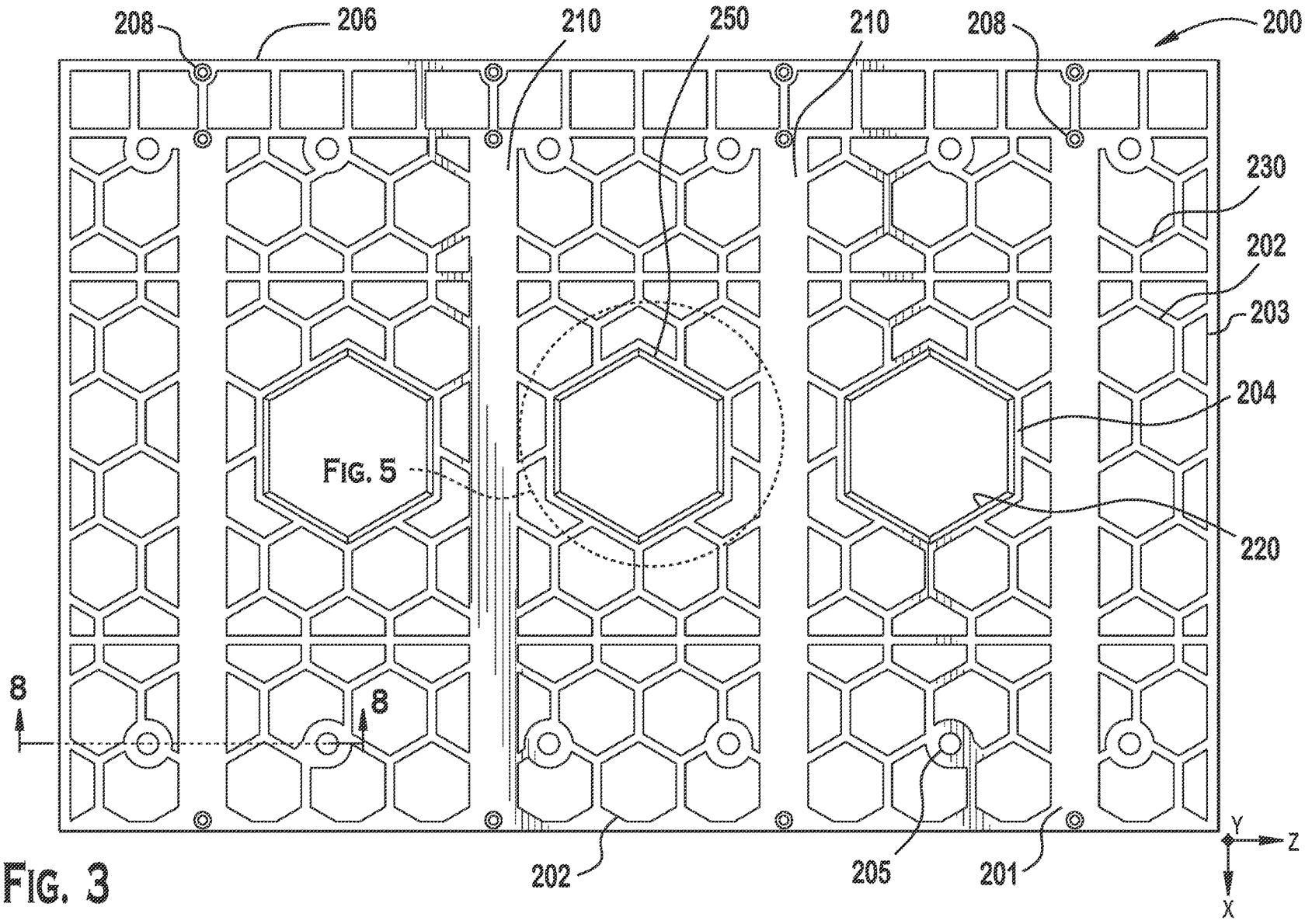
FIG. 3 is a top view of a modular grid of a paver supporting apparatus of FIG. 1.

The geometric lattice 230 extends substantially over the top surface 201, and down through a grid depth 209. As shown in FIG. 3, the geometric lattice 230 has a plurality of regular shaped polygons 202 and a plurality of an irregular shaped polygons 203 formed therein. The regular shaped polygons 202 are formed, in this embodiment, for example, as a hexagon 204 but it should be understood by those reasonably skilled that other numbers of polygon sides are possible and within the scope of the invention.

Figure 8:
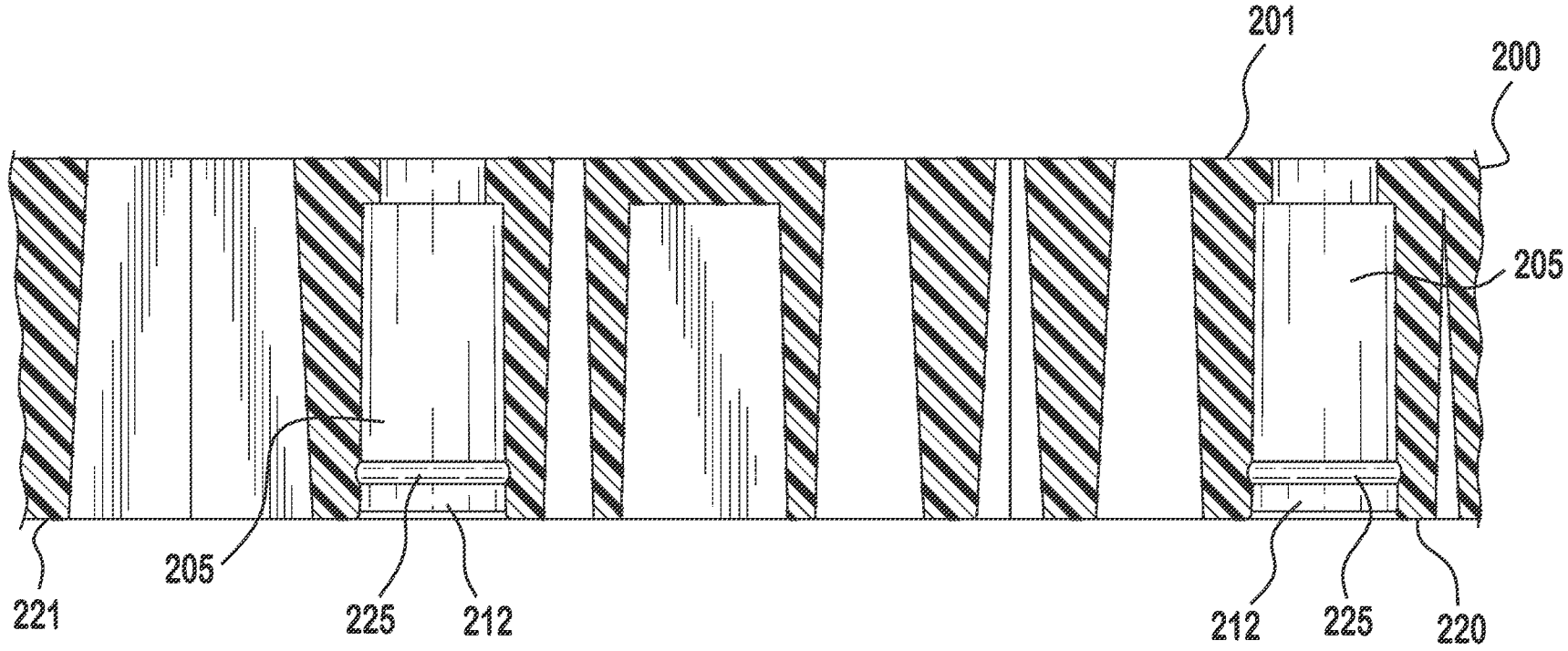
FIG. 8 is a partial cross-sectional view taken along the line 8-8 of FIG. 3, of a pedestal receiver according to the invention.

As illustrated, in FIGS. 1, 3, 5, and 8, a plurality of pedestal receivers 205 are located along the modular grid 200. Each pedestal receiver 205 is an opening positioned along a bottom surface 220 of the modular grid 200 extending up through the top surface 201 as seen in FIGS. 3 and 8. Along a lower segment 212 of each pedestal receiver 205, is a rib receiver 225. The rib receiver 225 has a semicircular profile extending around the interior of the pedestal receiver 205 along the lower segment 212. Shown in FIG. 3, spaced along portions of an exterior 206 of the modular grid 200, are a plurality of screw receivers 208.

Figure 9:
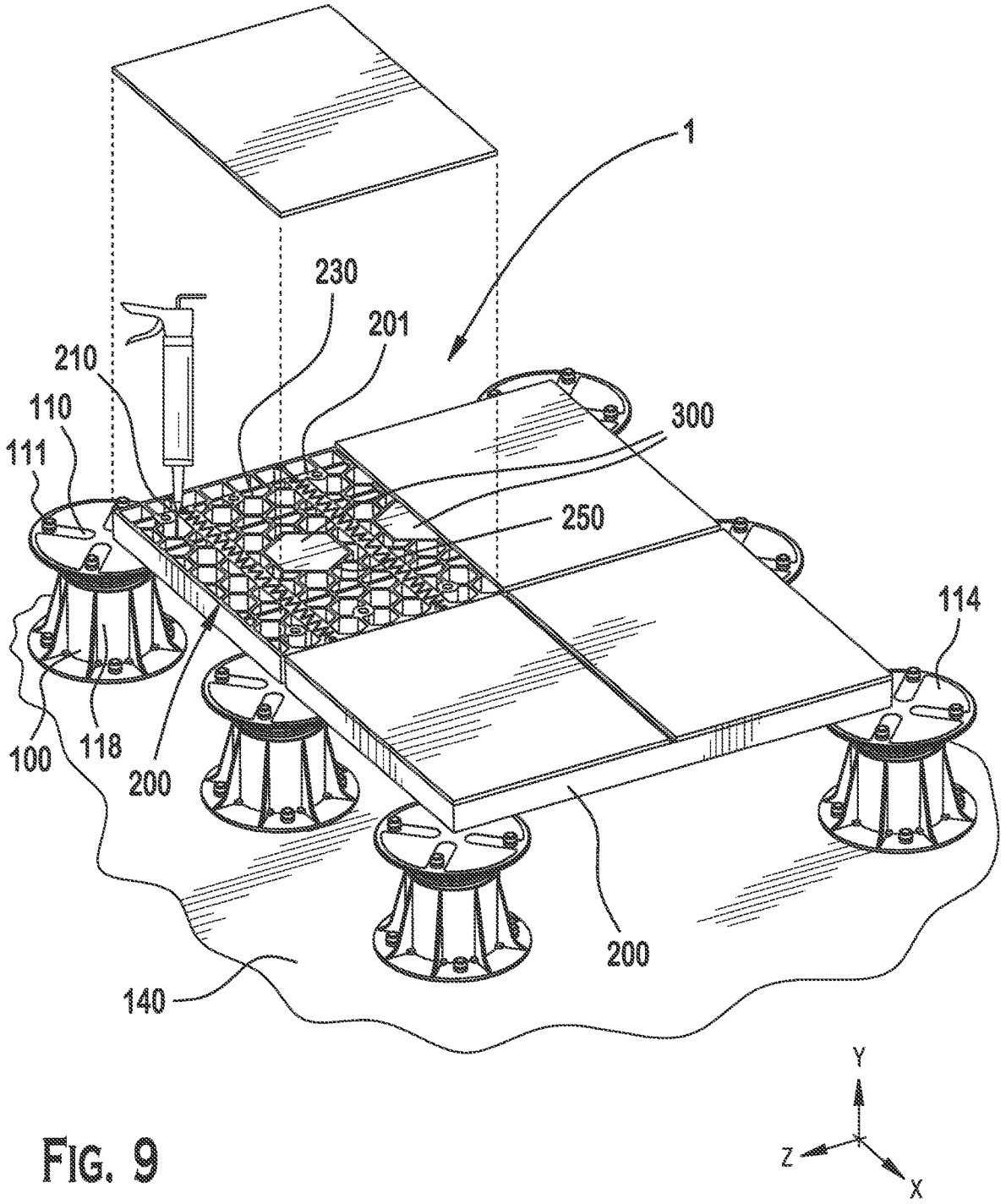
FIG. 9 is a perspective view of a paver supporting apparatus according to the invention, shown in use.

Extending substantially along the width of the modular grid 200, in the x-direction, as seen in FIGS. 1, 3 and 9, is a plurality of planar adhesive receiving sections 210. The planar adhesive receiving sections 210 are positioned in part on opposing central sides of the ballast receiving openings 250, as shown in FIG. 1. It should be understood that the dimensions, position and number of planar adhesive receiving sections 210 may vary. The ballast receiving openings 250 extend from the top surface 201 down through the grid depth 209 and along a tapered length 251. The ballast receiving openings 250 exit the modular grid 200 to the exterior along the bottom surface 220 adjacent a planar underside 221.

As shown in FIGS. 1 and 3, the plurality of ballast receiving openings 250 are positioned along the modular grid 200 and are separated along the modular grid 200 by the plurality of the irregular shaped polygons 203 and the planar adhesive receiving sections 210 in a longitudinal z-direction. One of ordinary skill in the art would understand that there are other possible positions for the plurality of ballast receiving openings 250 depending upon the installation.

Figure 5:
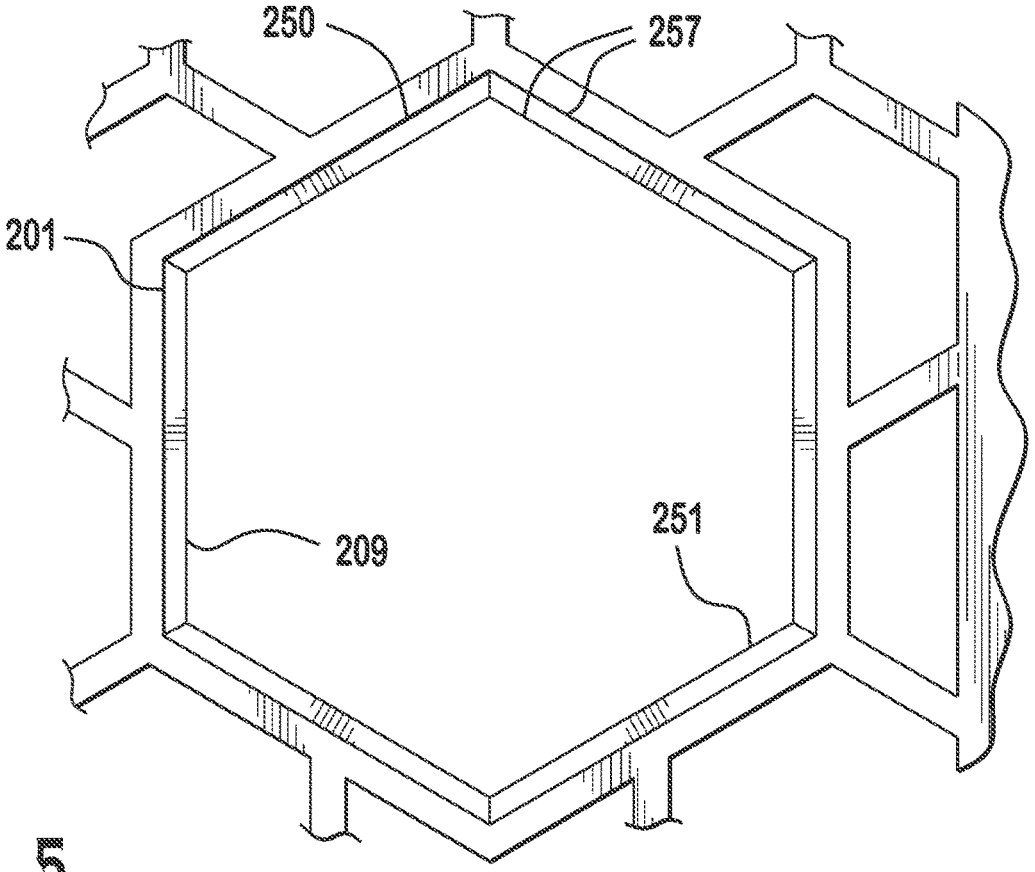
FIG. 5 is a top view of a tapered opening of the modular grid according to the invention.

The tapered length 251, as shown in FIG. 1, is formed on each one of the ballast receiving openings 250. The ballast receiving openings 250, may extend along the tapered length 251, as a hollow tapered regular polygon column 252, or for example, a hollow tapered hexagonal column 253, with the sides of the ballast receiving openings 250 outlining the geometric shape along and around the tapered length 251. Likewise, as shown in FIGS. 1 and 5, the ballast receiving opening 250 has a complimentary shape 257 along and around the tapered length 251.

Figure 4:
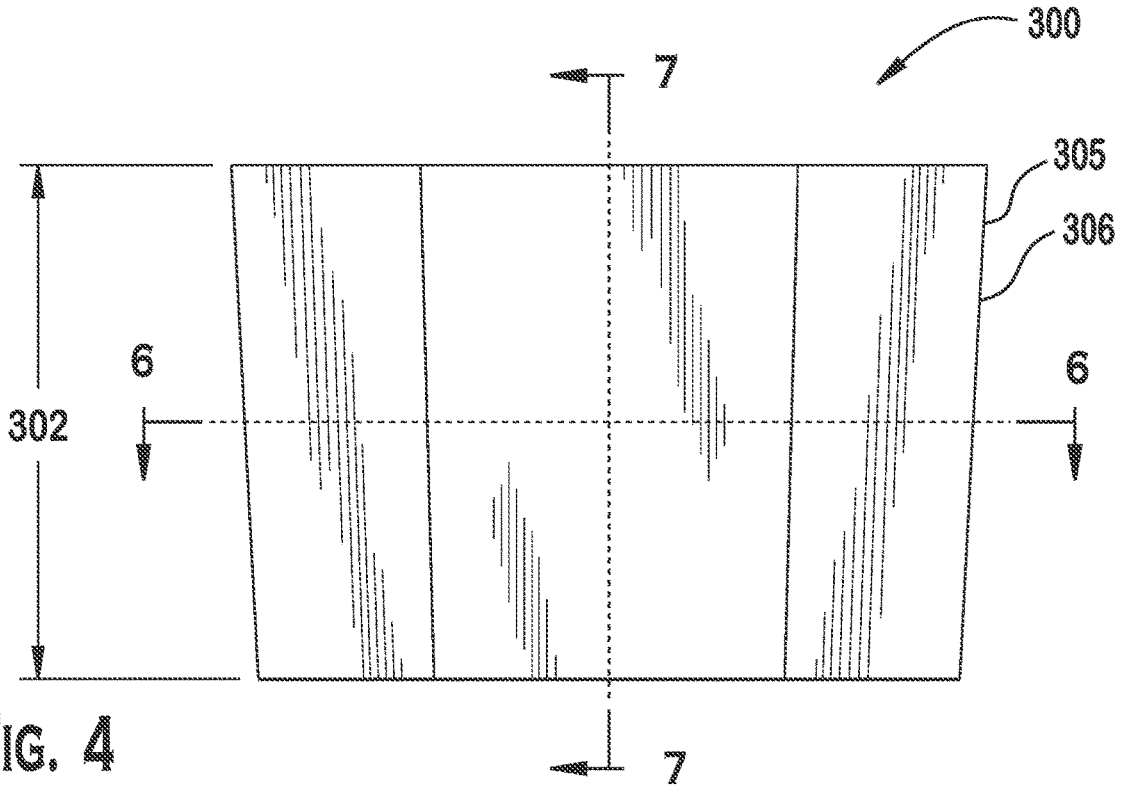
FIG. 4 is a side view of a ballast according to the invention of FIG. 1.
Figure 6:
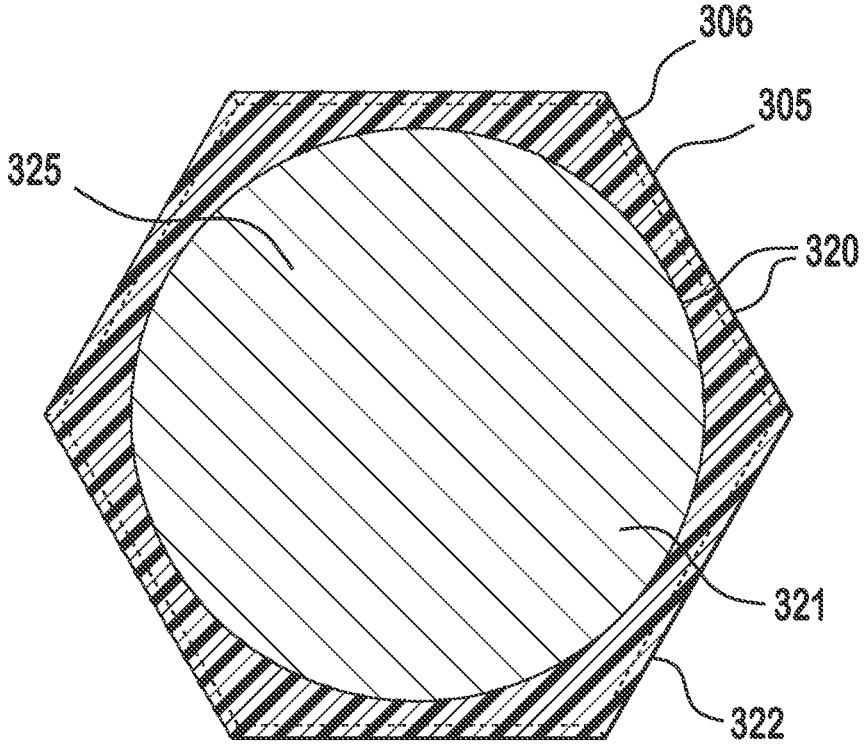
FIG. 6 is a top cross-sectional view taken along the line 6-6 of FIG. 4, of a ballast according to the invention.
Figure 7:
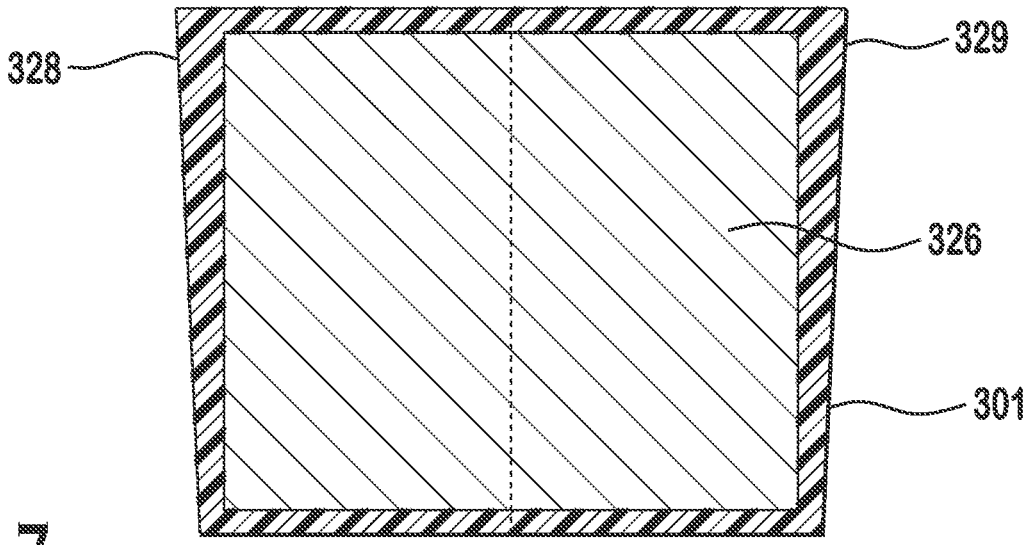
FIG. 7 is a side cross-sectional view taken along the line 7-7 of FIG. 4, of a ballast according to the invention.

In FIGS. 1 and 4, the ballast 300 generally has a tapered column 301 and may optionally have a non-uniform density 320. The tapered column 301 is formed along a ballast length 302. The ballast 300, may have, as in this embodiment, a non-uniform density 320, as illustrated in FIGS. 6 and 7. The ballast 300 in some embodiments may have a high density portion 321 and a low density portion 322. For example, the high density portion 321 may be a metal 325 and the low density portion 322 may be a thermoplastic 328. The ballast 300 in some embodiments has a metal core 326 and a thermoplastic outer body 329. Various configurations of singular or non-uniform densities are possible and within the scope of the invention. One skilled in the art should appreciate that other materials could be used to make up the ballast 300.

As shown in FIGS. 1, 6 and 7, the ballast 300 is a tapered regular polygon column 305 and in some embodiments, is a tapered hexagonal column 306. One of ordinary skill in the art would understand that the individual weights of each ballast 300 may vary depending upon the application and a variety of factors such as the desired wind resistance rating and ballast requirements. In an exemplary embodiment of the invention, the ballast 300 has a ballast weight in the range of 1.5-57.5 ballast pounds per square/foot. In another exemplary embodiment of the invention, the ballast 300 has a ballast weight in the range of 1.5-7.5 ballast pounds per square/foot. In yet another exemplary embodiment of the invention, the ballast 300 has a ballast weight in the range of 10.5-17 ballast pounds per square/foot. In yet another exemplary embodiment of the invention, the ballast 300 has a ballast weight in the range of 26.5-32.5 ballast pounds per square/foot. In yet another exemplary embodiment of the invention, the ballast 300 has a ballast weight in the range of 51.5-57.5 ballast pounds per square/foot.

One skilled in the art would understand, the ballast weight is adjustable depending upon the ballast embodiment and the plurality of the ballast 300 that are present. As shown in FIG. 1, the ballast 300 has a complimentary shape 303 which is complementary to the ballast receiving opening 250.

The assembly of the paver supporting apparatus 1 will now be described. The paver supporting apparatus 1, has a pedestal 100 with the top plate 110, as shown in FIGS. 1, 2 and 9. The pedestal column 118, is engaged with the top plate 110 along the plate extender 116 engaging the threaded surface 130 with the interior thread 119. The pedestal 100, with the top plate 110 and the pedestal column 118, are positioned on a surface, such as a roof. The plurality of fastener openings 122 are connected to a mounting surface 140 along the face 123, the circular base 120 and the flange 121. The top plate 110 is adjusted to the appropriate height along the plate extender 116 and the threaded surface 130.

As shown in FIGS. 1, 8, and 9, along the top plate 110, one of the plurality of the male lock pins 111, with one of the ribs 113, is passed through the bottom surface 220, of the modular grid 200, along the lower segment 212 and into the pedestal receiver 205 adjacent the planar underside 221. One of the male lock pins 111 and one of the ribs 113, are then engaged with the rib receiver 225 in the pedestal receiver 205. The modular grid 200 is positioned on the dampener 114 and on the insert molded rubber pad 115, along the bottom surface 220 and the planar underside 221.

The ballast 300, as shown in FIGS. 1, 4 and 5, is positioned above the ballast receiving opening 250 along a portion of the modular grid 200. The ballast 300 is then lowered into position above the ballast receiving opening 250. The ballast 300 is then inserted into the ballast receiving opening 250 along the tapered length 251 of the ballast receiving opening 250 having the complimentary shape 257.

The ballast 300 is then friction fitted into the ballast receiving opening 250, and extends through the lower portion of the tapered length 251 and the grid depth 209 exiting the modular grid 200 along the bottom surface 220. The steps of inserting a ballast 300 into the modular grid 200 are repeated to achieve the appropriate ballast pounds per square/foot for the given application. Again, one of ordinary skill in the art would understand that the individual weights of each ballast 300 may vary depending upon the application and a variety of factors such as the desired wind resistance rating and ballast requirements. The ballast 300 along the top surface 201 of the modular grid 200 forms a flat surface co-planar with the top surface 201 upon insertion into the ballast receiving opening 250.

As shown in FIGS. 1, 3 and 9, along the exterior 206 of the modular grid 200 are a plurality of the pedestals 100. The plurality of pedestals 100 are movable in a plurality of directions and adjustable for various sized products and installations. Each one of the plurality of pedestals 100 has the plurality of male lock pins 111, positioned around the circumference 112 of each one of the plurality of top plates 110.

The plurality of top plates 110 are each adjusted along the plate extender 116 and the threaded surface 130 positioning the plurality of top plates 110 to the appropriate heights. This positioning of the plurality of top plates 110 is repeated for each one of the plurality of pedestals 100 in accordance with the height requirements for each one of the plurality of pedestals 100 based on a position of each one of the plurality of pedestals 100 along the mounting surface 140.

One of the ribs 113, formed on each one of the plurality of pedestals 100, are individually passed through the bottom surface 220 of the modular grid 200 along the lower segments 212 and into the pedestal receivers 205 adjacent the planar underside 221. As a result, the plurality of the male lock pins 111 and the plurality of the ribs 113 are then engaged with the rib receivers 225 in the pedestal receivers 205. The modular grid 200 is positioned on the dampeners 114 and on the insert molded rubber pads 115 along the bottom surface 220 and the planar underside 221.

In FIGS. 1 and 9, a plurality of the modular grids 200 are adjacent and interconnected by the plurality of pedestals 100. The plurality of male lock pins 111 and the plurality of the ribs 113 each engage with one of the plurality of the rib receivers 225 in one of the plurality of the pedestal receivers 205 along and around the plurality of the modular grids 200. The plurality of the modular grids 200 each have a portion positioned on the dampeners 114 and on the insert molded rubber pads 115 along the bottom surfaces 220 and the planar undersides 221 of each one of the modular grids 200.

Operation of the paver supporting apparatus 1, will now be shown in FIGS. 1 and 9. Along the width of the plurality of the modular grids 200 in the x-direction, as seen in FIGS. 1 and 9, are the plurality of the planar adhesive receiving sections 210. The planar adhesive receiving sections 210, are positioned in part, on opposing central sides of the ballast receiving openings 250, as shown in FIGS. 1 and 9. The plurality of ballast 300 are positioned in the plurality of the ballast receiving openings 250 and are coplanar with the top surface 201 along their portions of the plurality of modular grids 200.

The plurality of the planar adhesive receiving sections 210 are coated with a type of adhesive along their lengths. Upon application of the adhesive the user can proceed to the next part of the assembly. One of ordinary skill in the art would understand that the individual weights of each ballast 300 or use of a ballast 300 may vary depending upon the application and a variety of factors such as the desired wind resistance rating and ballast requirements. In the final state, the ballast 300 and the top surface 201 of the plurality of the modular grids 200 may be covered by some type of a paver or a similar covering such as a tile or a plank.

The foregoing illustrates some of the possibilities for practicing the invention. Many other embodiments and fields of use for the paver supporting apparatus 1 are possible and within the scope and spirit of the invention. It is, therefore, intended that the foregoing description be regarded as illustrative rather than limiting.

What is claimed is:

1. A paver supporting apparatus comprising:

a pedestal having:

a top plate with a plate extender, and a plurality of male lock pins positioned around a circumference of the top plate; and a modular grid positioned and secured on the top plate such that the top plate supports the modular grid in an elevated position and having a rib receiver extending around an interior of a pedestal receiver and engaging one of the plurality of the lock pins and a lattice extending generally between perimeter edges of the modular grid and defining a plurality of lattice openings.

2. The paver supporting apparatus of claim 1, further comprising a tapered ballast receiving opening defined through the modular grid in an area of the lattice.

3. The paver supporting apparatus of claim 2, wherein the tapered ballast receiving opening extends from a top surface down toward an underside.

4. The paver supporting apparatus of claim 3, further comprising a ballast friction fitted in the tapered ballast receiving opening.

5. The paver supporting apparatus of claim 4, wherein the ballast is a tapered column complimentary to the tapered ballast receiving opening.

6. The paver supporting apparatus of claim 2, wherein the tapered ballast receiving opening is a regular polygon.

7. The paver supporting apparatus of claim 5, wherein the ballast is a tapered polygon column.

8. The paver supporting apparatus of claim 5, wherein the ballast has a non-uniform density.

9. The paver supporting apparatus of claim 8, wherein the ballast has a high density portion.

10. The paver supporting apparatus of claim 8, wherein the ballast has a low density portion.

11. The paver supporting apparatus of claim 1, wherein a pedestal column engages with the top plate.

12. The paver supporting apparatus of claim 8, wherein the ballast is a thermoplastic.

13. The paver supporting apparatus of claim 8, wherein the ballast has a metal core and a thermoplastic outer body.

14. The paver supporting apparatus of claim 1, wherein the top plate includes a male lock pin positioned on the top plate.

15. The paver supporting apparatus of claim 14, wherein the modular grid includes a plurality of pedestal receivers positioned along an exterior edge thereof to receive the male lock pin.

16. The paver supporting apparatus of claim 1, wherein the top plate has a dampener extended along the top plate in a recessed section.

17. The paver supporting apparatus of claim 16, wherein the dampener is an insert molded rubber pad.

18. The paver supporting apparatus of claim 1, having a plurality of pedestals.

19. The paver supporting apparatus of claim 18, having a plurality of modular grids interconnected by the plurality of pedestals along a plurality of exterior edges of the plurality of modular grids.

20. The paver supporting apparatus of claim 19, wherein the top plate has a plurality of male lock pins positioned along a circumference.

21. The paver supporting apparatus of claim 20, wherein each of the plurality of male lock pins includes a rib medially positioned thereon.

22. The paver supporting apparatus of claim 21, wherein the plurality of modular grids include a plurality of pedestal receivers positioned along an exterior edge thereof to receive the one of the plurality of male lock pins.

23. The paver supporting apparatus of claim 22, wherein each of the plurality of pedestal receivers includes a rib receiver to correspond with one of the plurality of male lock pins.

24. A paver supporting apparatus comprising:

a pedestal having:

a top plate with a plate extender, and a plurality of male lock pins positioned around a circumference of the top plate, a rib medially positioned and extending around a circumference of each one of the plurality of male lock pins; and a modular grid positioned and secured on the top plate such that the top plate supports the modular grid in an elevated position and having a rib receiver engaging one of the plurality of the lock pins and a lattice extending generally between perimeter edges of the modular grid and defining a plurality of lattice openings.

* * * * *